US005203614A

United States Patent [19]

Robbins et al.

[11] Patent Number: 5,203,614

[45] Date of Patent: Apr. 20, 1993

[54] TUNNELING MACHINE HAVING LIQUID BALANCE LOW FLOW SLURRY SYSTEM

[75] Inventors: Richard J. Robbins; David T. Cass, both of Seattle; Peter B. Dowden, Kirkland, all of Wash.

[73] Assignee: The Robbins Company, Kent, Wash.

[21] Appl. No.: 716,847

[22] Filed: Jun. 17, 1991

[51] Int. Cl.[5] ..... E21D 9/08

[52] U.S. Cl. ..... 299/33; 299/1.9; 299/56; 405/144

[58] Field of Search ..... 299/11, 33, 56, 1.3, 299/1.8, 1.9; 405/141, 144

[56] References Cited

U.S. PATENT DOCUMENTS

| | | | |
|---|---|---|---|
| 4,165,129 | 8/1979 | Sugimoto et al. | 299/11 |
| 4,406,498 | 9/1983 | Akesaka | 299/11 |
| 4,456,305 | 6/1984 | Yoshikawa | 299/33 |
| 4,607,889 | 8/1986 | Hagimoto et al. | 299/33 |
| 4,629,255 | 12/1986 | Babendererde et al. | 299/33 |
| 4,630,869 | 12/1986 | Akesaka et al. | 299/33 |
| 4,774,470 | 9/1988 | Takigawa et al. | 324/337 |
| 4,818,026 | 4/1989 | Yamazaki et al. | 299/56 |
| 4,844,656 | 7/1989 | Babendererde et al. | 405/144 |
| 4,848,963 | 7/1989 | Babendererde et al. | 405/144 |
| 4,881,862 | 11/1989 | Dick | 414/218 |

FOREIGN PATENT DOCUMENTS

| | | | |
|---|---|---|---|
| 3537593 | 9/1986 | Fed. Rep. of Germany | 299/56 |
| 1083322 | 9/1967 | United Kingdom . | |

*Primary Examiner*—David J. Bagnell

*Attorney, Agent, or Firm*—Graybeal Jackson Haley & Johnson

[57] ABSTRACT

A tunneling machine convertible between a "closed mode" and an "open mode" of operation, having a rotatable cutterhead with muck openings communicating with a pressurizable cutterhead chamber and a pressure maintenance system to stabilize the tunnel workface when operating in the "closed mode". In the "closed mode" low slurry flow is employed as a liquid pressure balance solely to support the unstable tunnel face. Low slurry flow is supplied through a pressure bulkhead sealing the cutterhead chamber and pressurized conveyor means through the bulkhead removes tunneled material from the cutterhead chamber. A pressure lock connected to the pressurized conveyor means transfers tunneled material to dewatering and reservoir-/accumulator means operated at substantially atmospheric pressure. Slurry, with at least most of the solids removed, is recycled to the slurry inlet at a controlled low flow rate matching the rate of removal of tunneled material and slurry from the tunnel face so the otherwise unstable tunnel face is maintained stable. In the "open mode" of operation, for use in boring a self-stabilizing tunnel face, the pressure bulkhead is removed and a second conveyor, such as a belt conveyor, is disposed adjacent to the "closed mode" conveyor to withdraw cuttings from the cutterhead chamber.

21 Claims, 10 Drawing Sheets

TUNNELING MACHINE HAVING LIQUID BALANCE LOW FLOW SLURRY SYSTEM

BACKGROUND OF THE INVENTION

The present invention pertains to tunneling machines. More specifically the present invention relates to convertible tunneling machines that employ a low flow of slurry to prevent tunnel face subsidence by creating a liquid balance, but not as a transport medium.

Diverse ground conditions are encountered in the excavation of some tunnels. Sand, marl, limestone, clays, and chalk may all be expected. At times, various types of ground may be encountered simultaneously. The water tables along a tunnel also vary considerably. This inconsistency of tunnel geology demands a convertible machine. In many of these ground conditions, support of the face is necessary to prevent ground settlement or the creation of excessive voids around the tunnel lining. In other areas face support is not necessary. Such a convertible machine that is fast and convenient to reconfigure does not exist in the prior art.

Effective methods of workface control commonly used to support unstable soil faces are the slurry and earth pressure balance (EPB) shield methods. A traditional slurry system requires a large surface plant with filter presses to remove fine clay particles suspended in a dilute slurry. In addition, a large diameter slurry discharge line must be continuously extended as the TBM (tunnel boring machine) advances. This discharge line typically runs the tunnel length to the surface plant.

The other conventional approach for workface control, earth pressure balance, eliminates the slurry discharge line and surface plant. The primary concern with a EPB system is the possibility of plugging inside the very large cutterhead, and for this reason the muck must be kept as fluid as possible. Fluid mixed with appropriate additives must be injected into the head to maintain the proper pressure to ensure face stability. The material most likely to cause plugging is moist clay, but its flowability characteristics can be improved by the addition of polymers. In addition, the torque requirements for cutterhead rotation for a large diameter cutterhead are extremely high for an EPB design. Thus, an adequate system for tunnel face control in unstable soil conditions is currently lacking in the prior art, even aside from the lack of convertability of the conventional slurry and EPB soft ground systems to a hard ground system when desired.

Tunneling machines previously known in the art that either employ a conventional slurry or an earth pressure balance system to control an unstable tunnel workface, or that operate in varying geological conditions, are described below.

United Kingdom Patent No. 1,083,322, issued to Bartlett, uses a tunneling apparatus including a shield containing or supporting a power driven rotary mechanical digging mechanism in front of a bulkhead, in which a liquid thixotropic suspension is delivered under pressure to the space in front of the bulkhead so as to contact the working face on which the digging mechanism acts and the spoil excavated by the digging mechanism is removed together with a proportion of the liquid suspension The material removed from the tunneling shield is partially cleaned or separated, and the cleaned constituent containing a high proportion of the thixotropic suspension is returned to the space in front of the bulkhead. The material removed from the shield is moved to a point at the rear, but within the formed portion of the tunnel, to be cleaned. The discharge duct is preferably at an elevated level in the bulkhead. One result of this construction, as broadly suggested by this patent, is that it may be possible, when conditions permit, to operate the shield as a conventional mechanical tunneling shield without the liquid suspension, and to remove spoil by means of a belt conveyor or the like.

U.S. Pat. No. 4,881,862, issued to Dick, discloses a screw seal having a conveying section feeding into a sealing section within a housing, wherein the sealing section has a divergent cross sectional area. The divergence is predetermined in conjunction with the compressibility and permeability of the bulk solids and the coefficient of friction between the solids and the barrel of the sealing section, so as to permit the formation of a sufficiently dense plug of the solids to form an effective gas seal, but to limit the solids pressures and thereby to control the resulting increase in driving torque. Other features comprise a number of variations in the structures of the conveying and sealing sections, and also the discharge chamber into which the sealing plug is driven. These permit a large variety of applications and with many different types of bulk solid materials.

U.S. Pat. No. 4,848,963, issued to Babendererde et al, discloses an earth pressure shield for a tunnel excavator having a front working compartment formed by a separating wall, having a digging tool and an annular reinforcing space substantially triangular in cross section positioned directly in front of the separating wall. So that extensive restructuring of the machine is not necessary when moving from soft roof to hard ground, the annular reinforcing space is provided with a lower fluid feeder, a controlled upper pressurized air feeder, a plurality of fluid connector pipes which are guided from below to an upper fluid outlet opening into the working compartment, and a fluid level controller.

U.S. Pat. No. 4,844,656, issued to Babendererde et al discloses an earth pressure shield having a front working compartment, having at least one digging or mining tool, and formed by a separating wall, in which an annular space is formed with a top region connected with a regulated pressurized air feed and with a bottom region opened to the digging or mining tool so that the dug or mined earth material is moved with the help of a conveyor unit. At least one fluid pipe is guided from a fluid chamber with a first level controller and with the fluid feeder to a fluid outlet opening to the digging or mining tool.

Behind the working compartment formed with an immersed wall, a bulkhead space is provided by partitioning. The bulkhead is connected in an upper region with the top region of the annular space by an opening in the separating wall and includes the fluid chamber in a lower region. In an additional partitioned chamber or space, a bulkhead space is provided to the rear of the working chamber in which the immersed wall is located and which partitions the front portion of the tunnel and/or digging machine. The drive for the digging wheel, the pressurized air feed for clearing the working compartment, mixing devices, and a screw conveyor all project through this bulkhead space. The lower and larger part of the bulkhead space is filled with water and/or a muck suspension, while the upper part is filled with compressed air which, because of the upper connection of the pressurized air cushion behind the immersed wall, stands under the same predetermined pressure as acts on the earth material behind the immersed wall.

The fluid pipe, which opens in the lower portion of the bulkhead space, guides water and/or the suspension through the upper part of the bulkhead space filled with pressurized air and through the pressurized air cushion located behind the immersed wall in the vicinity of the roof of the front part of the working compartment. Also, feeder means for water and/or suspension, which supply the bulkhead which is penetrated by the digging tool, is connected to the water filled bulkhead space.

The air cushion with a predetermined regulated pressure guarantees the same constant pressure on the earth material located behind the immersed wall and the water and/or suspension located in the partitioned portion. Measuring and control systems provide that the level of the earth material and the water itself are the same, i.e. at the same height. The shear resistance of the earth material in the working compartment prevents the predetermined supporting pressure in the pressurized air cushion from being transmitted to the local front wall, especially in the sensitive roof region. A zone of lower pressure arises in which the water and/or suspension flows into the roof region of the front part of the working compartment through the ducts from the bulkhead rear space.

A nonreturn valve opens only when the predetermined supporting pressure is not attained. Simultaneously the water and/or the suspension standing under the predetermined supporting pressure flows by feed means in the digging wheel into the space through which the digging tool travels in front of the digging wheel.

Mixing and stirring devices behind the immersed wall provide for a uniform mixing of the earth material with the delivered fluid. Regulated pressurized air feed is guided through the partition of the bulkhead space. To obtain the best possible mixing of the dug earth material with the fluid (water an/or suspension), at least one stirring unit is located in the bottom region of the working compartment behind the immersed wall. A nonreturn or check valve for the fluid outlet is provided so that a predetermined supporting pressure is not exceeded.

U.S. Pat. No. 4,818,026, issued to Yamazaki et al, discloses a device that transfers cut bedrock through the cutterhead to the tunneling machine interior. In a central area of the cutterhead compartment is provided a debris receiving chamber into which are channeled the front-end portion of a screw conveyor and the front-end portion of a water supply pipe. A rear-end portion of the water supply pipe is connected to a water-supply source disposed in a rear area of the tunneling apparatus. The water issues from such water supply source to the debris receiving chamber through its upper opening so that the cutterhead compartment is filled with water which buoys up the rock debris to enable the debris to easily enter the debris receiving chamber through its upper opening under the influence of the rotational movement of the cutterhead compartment. The rock debris received in the debris receiving chamber is transported rearwardly together with water by means of the screw element of the screw conveyor, reaching an outlet opening of an outer sleeve of the screw conveyor, and then dropping therefrom to a rock crusher.

U.S. Pat. No. 4,774,470, issued to Takigawa et al, is for a tunneling machine having electromagnetically based sensors that detect and display conditions of the tunnel earth. The invention includes an electromagnetic wave transmitting and receiving unit mounted on the top of the shield machine for radiating electromagnetic impulse waves towards the tunnel earth and for receiving the electromagnetic waves reflected from the tunnel earth. A position sensor collecting information regarding the position of the electromagnetic waves, wave transmitter and receiver unit is included. A data processing unit is provided for processing the signals from the transmitter/receiver and the position sensor as sent through a transmission line. The data processing unit continuously displays the condition of the tunnel earth at the cutting fact.

U.S. Pat. No. 4,630,869, issued to Akesaka et al discloses a shield tunneling machine having a partition wall. A lidded opening is formed in the upper portion of the partition wall. The lid is pivotally connected through an arm to the piston rod of a pneumatic or hydraulic cylinder mounted on the wall member and the cylinder keeps the opening normally closed. However, when the pressure of muck received in the space between the partition wall and the cutterhead exceeds the pressure sent to the cylinder, the lid moves pivotally toward the partition wall against the pressure of the cylinder to open the opening, permitting muck flow into the muck chamber. In the muck chamber are disposed a rotor and a stator constituting a crusher for crushing relatively large gravel entering the muck chamber. The rotor is mounted on a rotary shaft and the stator below the rotor is mounted on the partition wall. High pressure water is sent into the muck chamber through a water supply pipe and the supplied water is discharged from the muck chamber together with the muck to the rear portion of the shield body through a drain pipe.

This shield tunneling machine also comprises a tubular shield body, a partition wall provided in the shield body, a rotary shaft rotatably supported by the partition wall and extending along the axis of the shield body, a cutterhead disposed on the front end of the rotary shaft and including a first cutter provided with a plurality of cutter bits and a second cutter provided with a plurality of roller bits, a mechanism for rotating said cutterhead by means of a rotary shaft and a mechanism for relatively moving straight forward and backward one or the other of the first and second cutters. The cutter bits and roller bits are mounted respectively on the first and second cutters so that one of the cutter bits and roller bits can be projected and the other can be retracted for excavation according to the geology of the face. Thus, this shield tunneling machine can be used for excavating either soft or hard ground. Further, the roller bits do not hinder the excavating operation of the bits in excavating the soft layer and the cutter bits are not damaged by the excavating operation of the roller bits in excavating the hard layer.

U.S. Pat. No. 4,629,255, issued to Babendererde discloses a tunneling apparatus with a lateral shield having a front end normally engaged longitudinally against a tunnel end face, a digging tool at the front end of the shield and engageable with the tunnel face, and a drive for displacing the tool and digging the tunnel face. A transverse pressure wall across the shield forms a pressurizable chamber inside the front end of the shield around the tool at the tunnel face. A conveyor tube longitudinally traverses and has a front end open ahead of the wall in the chamber and is adapted to receive material freed from the tunnel face by the digging tool.

An auger can be rotated in the tube to displace freed material back in it from its front end to its rear end. A chute opens upwardly into the rear end of a conveyor tube to receive material therefrom and a pump tube extends longitudinally back from the chute. A piston pump between the chute and the pump tube can displace material from the chute back to the tube. This disclosure recognizes that when driving a tunnel or shaft in soft ground the material that is dug out can be transported relatively easily by a piston pump constructed along the lines of a heavy-duty concrete pump. The tube can be a flexible hose that will not hinder operations behind the machine.

This patent also discloses a piston pump system attached to the conveyor tube that is pressurized by the earth slurry transported therein. The piston pump that drives this slurry through a flexible tube is said to be less cumbersome than the belt type conveyors used in the prior art.

U.S. Pat. No. 4,607,889, issued to Hagimoto et al, pertains to an apparatus for the mixing of a muddying material, such as a bentonite/slurry mix, in the cutterhead assembly. Specifically, rotary mixing means are situated in the outer periphery of the cutterhead chamber and the central portion of the cutterhead chamber. These mixing means rotate at different speeds and opposite directions. Specifically, the mixing means in the central portion rotates faster than that in the outer periphery in order to improve mixing efficiency in the entire chamber. The specific improvement over the prior art is said to be that the central portion of the rear wall of the cutterhead chamber rotates with the cutterhead as opposed to being stable as in the prior art. Consequently, fewer gaskets or seals are needed. In order to regulate the pressure of the muddying material in the cutterhead chamber, a conveyor cylinder having a screw conveyor and filled with muddying material is controlled to remove material from the cutterhead chamber at a variable rate. Slurry or mudding material is transferred from the cutterhead chamber through the tunneling machine through a conventional conveyor cylinder with screw auger. The slurry contained within the conveyor cylinder maintains the desired back pressure.

U.S. Pat. No. 4,456,305, issued to Yoshikawa, provides a shield tunneling machine which comprises a hollow shield main body; a cutter head rotatably disposed at one end of the main body; a pressure chamber formed within the main body immediately behind the cutterhead; an atmospheric pressure compartment formed within the main body in the rear of the pressure chamber; and an earth removing apparatus provided within the main body and holding the pressure chamber in communication with the atmospheric pressure compartment. The earth removing apparatus comprises a tubular casing having, at a front end portion thereof, an earth inlet opening to the pressure chamber, and at the rear end portion thereof a closable earth outlet communicating with the atmospheric pressure compartment, and an earth transport conveyor rotatably provided within the casing and comprising a helically twisted strip. Since the earth transport conveyor has no rotary shaft, the apparatus is capable of transporting and discharging earth containing relatively large solid fragments even when the shield main body or the tubular casing has a reduced diameter.

In this patent disclosure the earth from the workface, which may or may not be slurry, is transferred from the pressure chamber to the atmospheric pressure compartment by a conventional tubular casing having a novel helically twisted strip. The plug of earth in the conventional tubular casing maintains the desired pressure within the tubular casing.

U.S. Pat. No. 4,406,498, issued to Akesaka, teaches a shield tunneling machine in which the shield body comprises a thrust ram or advancing jack and a diaphragm is provided internally across the shield body in a portion spaced apart rearwardly of the front end of the shield body. The diaphragm has an upper opening which is a muck inlet. A bit or scraper is provided in the peripheral portion of the opening. The diaphragm and a member interposed therebetween constitute a casing which defines a muck chamber behind the diaphragm, the muck chamber being usually charged with a liquid. The opening in the diaphragm is an inlet through which the muck is introduced into the muck chamber. The muck inlet is closed and opened by a cover member.

The cover member is coupled to the piston rod of a dual hydraulic piston cylinder device attached to a wall member. A hydraulic pressure circuit for introducing a liquid pressure of a predetermined level into the cylinder retains the piston in a given position within the cylinder so that the cover member normally closes the muck inlet. As long as the pressure of the muck charged between the face and the diaphragm is maintained at a level capable of preventing collapse of the face, more specifically within the range of pressure larger than an active earth pressure in the face ground but smaller than the passive earth pressure thereof, the cover member closes the muck inlet. When the pressure of the muck rises above a predetermined level, the cover member is urged by the muck to open the muck inlet, thereby allowing admission of muck through the inlet. As soon as the muck pressure drops to the predetermined level due to admission of the muck into the muck chamber, then the hydraulic piston cylinder again urges the cover member to its muck inlet closing position.

The muck is discharged from the muck chamber through a muck discharge pipe provided in the casing member in the lower portion of the muck chamber. Discharge of the muck out of the muck chamber is accomplished without changing the muck pressure to a substantial extent and hence without causing collapse of the face.

U.S. Pat. No. 4,165,129, issued to Sugimoto et al, teaches a tunneling machine having a cutter chamber disposed at the front end of a shield frame and driven by cutter drive motors. Sealing members are sealingly disposed between the periphery of the cutter and the front edge of the shield frame. The front end portion of a screw conveyor is placed in the cutter chamber and is sealed in such a way that even when the cutter is driven, the water-tightness of the cutter chamber is maintained. A mucking adjustor for controlling the concentration of the slurry is disposed immediately below an unloading opening at the rear end of the screw conveyor and is communicated through a water supply pipe with a water tank, and through a discharge pipe with a muck-water separator. The muck separated by the separator is transported into a hopper which in turn transports the separated muck to a suitable disposal site. The water separated by the muck-water separator is returned to the water tank for recirculation.

The muck from the face fills not only the cutter chamber but also the screw conveyor through a loading opening so that an uncontrolled flow of the muck from the face to the cutter chamber is prevented. The muck in the cutter chamber is transported by the screw conveyor in a controlled quantity and is discharged through an unloading opening into the mucking adjuster. The muck in the mucking adjuster is agitated with the water charged through the water supply pipe and is discharged through the discharge pipe to the ground surface. The uncontrolled flow of water from the face into the cutter chamber can be prevented by maintaining the pressure of water charged into the mucking adjuster the same as the ground water pressure at the face. Even if the pressure of water charged into the mucking adjuster is changed, the fluctuating pressure is not transmitted to the face by the muck filled in the screw conveyor so that the face is maintained at a stable condition.

As apparent from the state of the prior art, a need exists for a tunneling machine operable in a "closed mode" for soft ground in which the cutterhead is pressurized, and in which low slurry flow is employed to prevent subsistence of an unstable tunnel face by creating a liquid balance without need for high volume recirculation of the slurry and without need for a bulky muck/slurry separation plant, a conventional slurry tunneling systems.

A need also exists for a tunneling machine of the above type in which a fast and convenient conversion can be performed between "closed mode" and "open mode" operation where the cutterhead is not pressurized and competent ground is tunneled.

A need exists as well for a tunneling machine of the above type in which the pressure lock employed in the "closed mode" of operation is a carousel type pressure lock having a substantially constant rate of material processing and a low profile.

A need further exists for a tunneling machine of the above type having an optional secondary separation system in the "closed mode" with hydrocyclone type removal of fines and a simple fresh bentonite addition capability for increased tunnel face stabilization.

SUMMARY OF THE INVENTION

The present invention is a tunneling machine designed to be operable in both a "open mode" for use in stable geological formations and in a "closed mode" for use in unstable or high water content inflow geological formations. The "open mode" provides high tunneling machine advance rates, while the "closed mode" provides a pressurized low flow slurry system that prevents subsidence of the tunnel face. In the "closed mode", the low flow slurry system employ pressurized slurry to stabilize the face but not as a transportation means for the muck. The liquid balance necessary for face stabilization in the "closed mode" is accomplished by adding sufficient water to control the face, to fluidize the muck and to reduce cutterhead torque. The low flow slurry system of the "closed mode" offers positive control of the slurry pressure and-does not require the high capacity pumps and large diameter pipe lines of a standard slurry system employed to transport muck.

The tunneling machine of the present invention includes a cutterhead powered by drive motors and axially rotatable relative to the tunneling workface. The cutterhead preferably includes a plurality of rolling cutters units mounted thereto. Adjacent the rolling cutter units are slit-like openings for passage of muck into the cutterhead chamber. Drag picks adjacent the slit-like muck openings are employed to promote passage of softer muck into the cutterhead.

Thrust cylinders provide forward thrusting of the cutterhead relative to the tunneling machine, and articulation cylinders provide angular movement for steering of the cutterhead face.

A belt conveyor, for use in the "open mode", and a screw conveyor, for use in the "closed mode", are oriented side-by-side in the cutterhead chamber. Retraction of the belt conveyor and assembly of a pressurized bulkhead converts the tunneling machine into the "closed mode" for unstable tunnel face conditions.

In the "open mode" high cutterhead speed is used to excavate the face with cuttings entering the cutterhead through the muck openings. Cuttings are then channeled along the belt conveyor and loaded onto a secondary conveyor which leads to muck cars for removal from the tunnel in a conventional manner.

In the "closed mode" of operation a relatively low cutterhead speed is employed. A slurry, optionally containing bentonite or the like, is pumped into the cutterhead chamber at a pressure to balance the prevailing ground water or earth pressure. The combination of pressure and the consolidating action of bentonite (if present) essentially prevent face collapse as excavation proceeds. The pressure at the tunnel face is a function of the back pressure in the muck discharge side of the system and the slurry flow pressure of the supply -side of the system. The back pressure in the discharges the system is controlled by the pressurized cutterhead, pressurized screw conveyor, and a pressure lock. The screw conveyor communicates with the cutterhead and the pressure lock. The pressure lock in turn communicates with a dewatering system kept at essentially atmospheric pressure which passes solid material from the tunnel face to a secondary conveyor for removal from the tunnel. In one embodiment of the present invention, the supply side of the system includes liquid from the dewatering tank, which is sent to a reservoir/accumulator. The reservoir/accumulator controls the slurry supply flow by feeding a low flow slurry into the cutterhead chamber to maintain tunnel face pressure.

In an alternate "closed mode" embodiment of the present invention, a secondary refining and separation system, having a fresh bentonite mixing system is connected to the reservoir/accumulator for use of bentonite-added slurry to maintain the tunnel face in the supply side of the system. The secondary separation system of this alternate embodiment also includes a hydrocyclone separation system that receives the fine particles from the screw conveyor which do not separate by gravity. These fine particles are processed by the hydrocyclone units such that the main fluid discharge from the hydrocyclones, containing the very fine solids fraction, is delivered to the fresh bentonite mixing system. Other materials from the hydrocyclone separation system, along with solids from the dewatering system, are transported along a secondary conveyor for removal from the tunnel.

In a preferred embodiment of the present invention, the pressure lock connecting the pressurized screw conveyor and the dewatering tank employed in the "closed mode" is a dual chambered pressure lock having swingable inlet gates and outlet gates that alternately allow each of the two chambers to be filled under pressure with material from the screw conveyor and to then be emptied into the dewatering tank system at substantially atmospheric pressure. In this manner, while one of the two dual chambers is being filled with material from the screw conveyor under pressure, the other of the two chambers is emptying its material into the dewatering tank at atmospheric pressure.

In an alternate embodiment of the present invention, the pressure lock is a carousel type lock mechanism allowing substantially constant material conveyance with a low profile configuration. This carousel pressure lock includes a plurality of wedge-shaped chambers that sequentially communicate with the screw conveyor under pressure and then sequentially rotate within the carousel under pressure to a carousel exit that is at atmospheric pressure and is in communication with the dewatering tank.

BRIEF DESCRIPTION OF THE DRAWINGS

These and other features of the invention will be more fully appreciated when considered in the light of the following specification and drawings describing and illustrating typical embodiments thereof, in which.

DETAILED DESCRIPTION OF THE PREFERRED EMBODIMENTS

Figure 1:
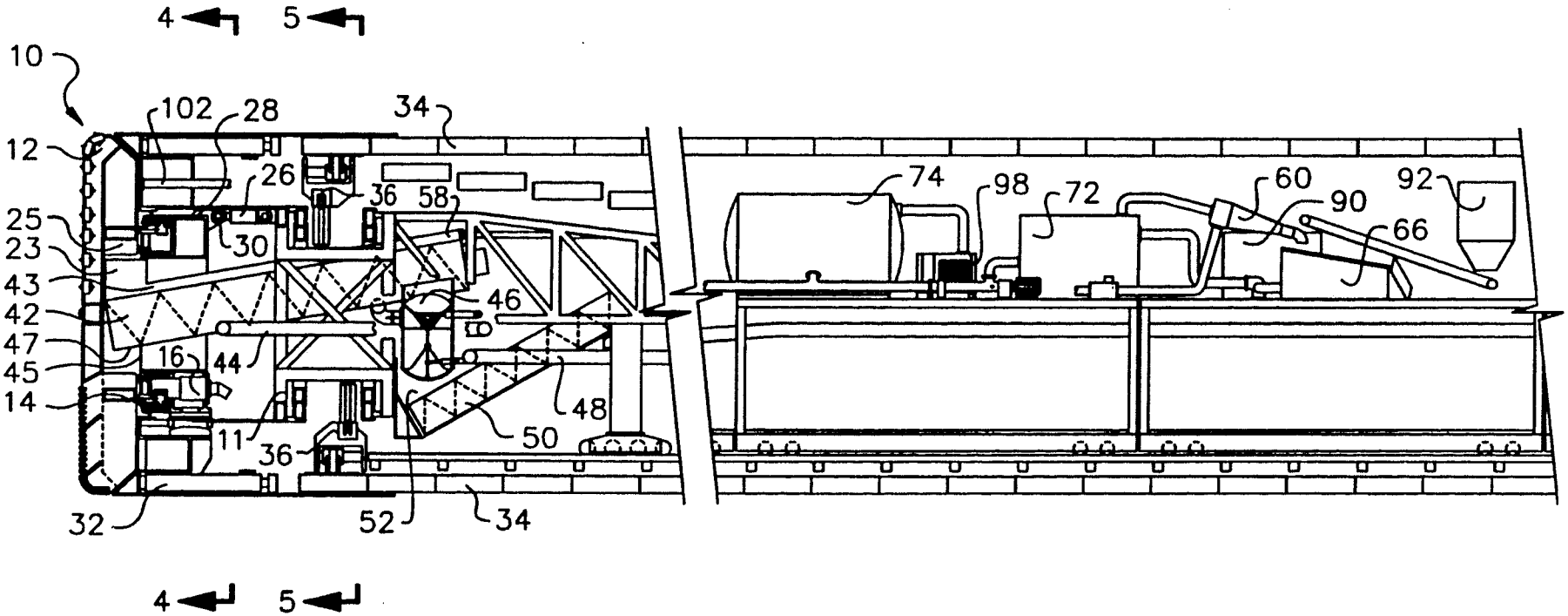
FIG. 1 is a side elevational view of a tunneling machine typifying the present invention.
Figure 2:
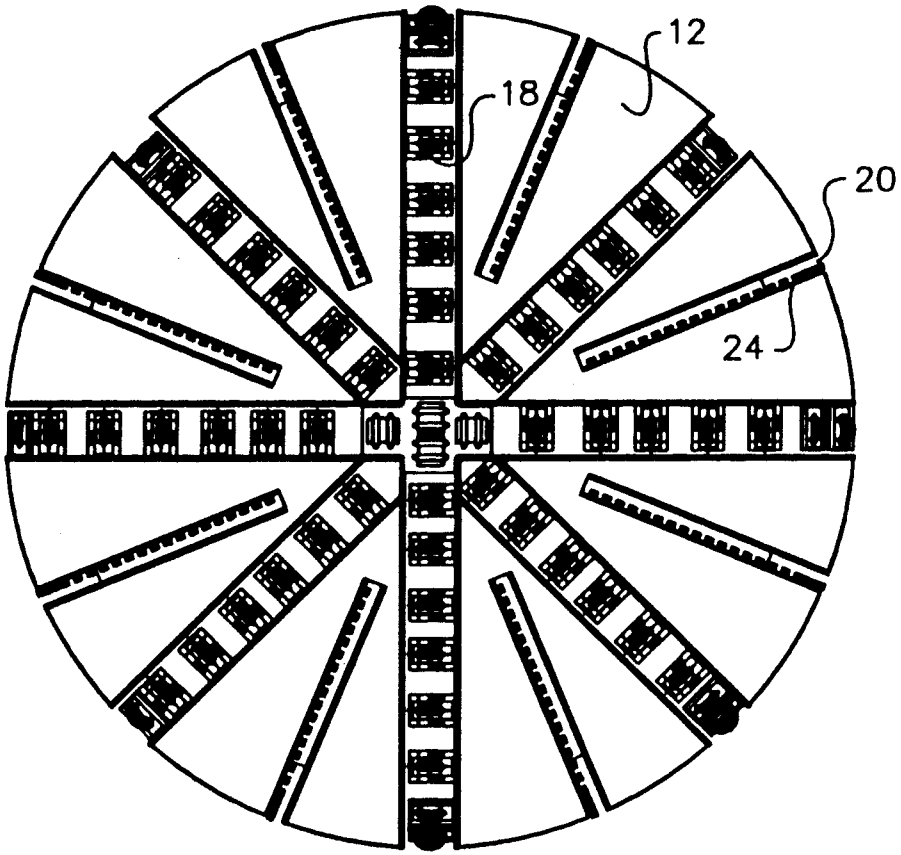
FIG. 2 is a front view of the cutterhead of the tunneling machine of FIG. 1.

The first embodiment illustrated pertains to a tunneling machine having a low flow liquid balance system. Referring to FIGS. 1 through 5, the overall components of the tunneling machine are described. Referring first to FIGS. 1 and 2, tunneling machine 10 includes a frame 11 and a cutterhead 12, which is rotatable relative to frame 11 on main bearings 14. Drive motors 16 power the relative rotation of cutterhead 12. Cutterhead 12 carries a plurality of roller cutters 18 which are preferably disposed in a plurality of cutter supports 20 in radial array. Located on the sections between adjacent cutter supports 20 are muck openings 22, which are preferably radially disposed slots, that communicate with cutterhead chamber 23. Cutterhead chamber 23 includes a plurality of muck buckets 25 which load tunneled material onto conveyors to be described in detail below. Adjacent muck openings 22 are a plurality of drag picks 24 which are useful in softer mucking conditions to guide muck into muck openings 22. Screw conveyor bypass 43 is substantially centrally located in cutterhead 12 and accommodates the bypass of muck from the screw conveyor described in detail below.

Figure 5:
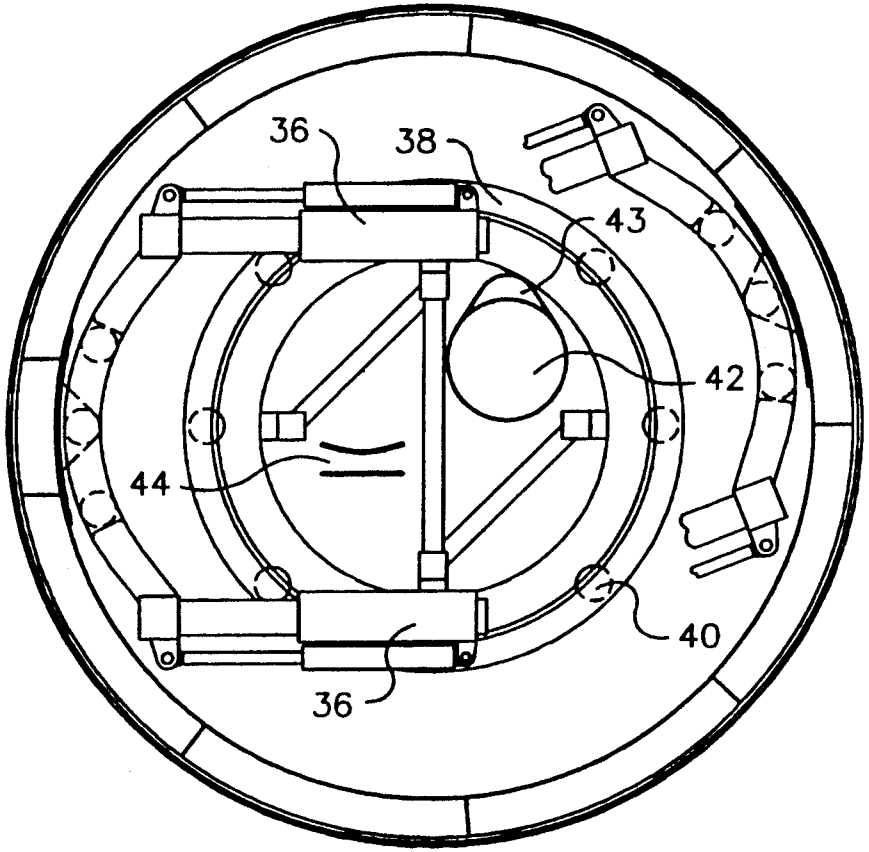
FIG. 5 is a cross-sectional view of the tunneling machine of FIG. 4 taken along lines 5—5 thereof.
Figure 4:
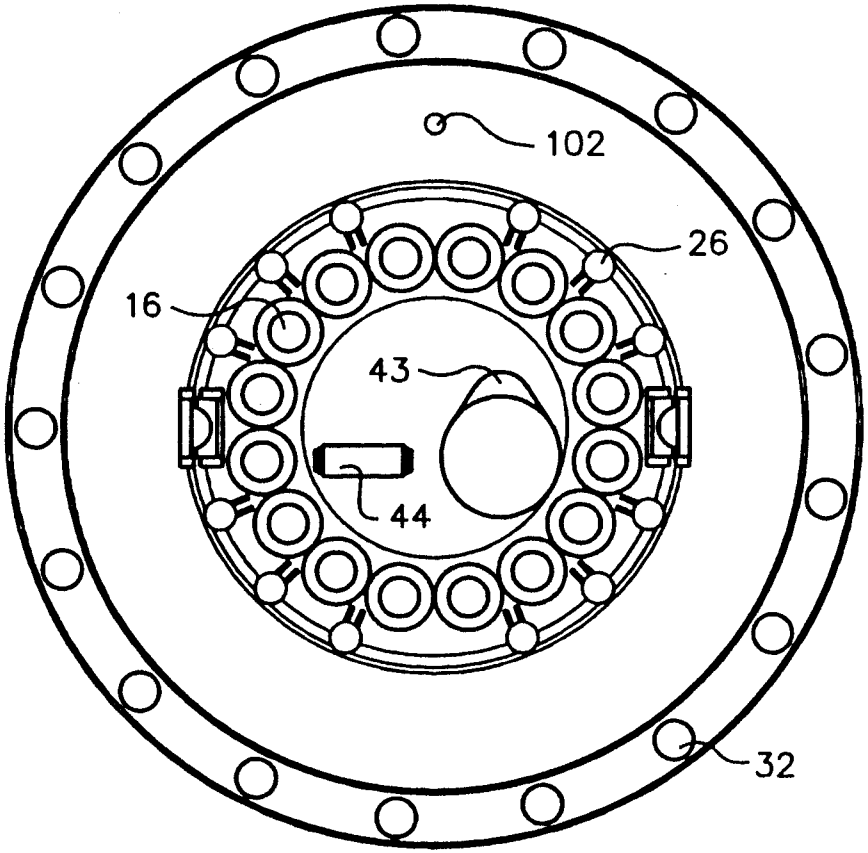
FIG. 4 is a cross-sectional view of the tunneling machine of FIG. 1 taken along lines 4—4 thereof.

Referring now to FIGS. 1 and 4 through 5, a plurality of articulation cylinders 26 are attached to clevises 28 of cutterhead 12 by pins 30 such that extension and retraction of articulation cylinders 26 causes angular movement of the face of cutterhead 12 relative to the plane of the tunnel work face. A plurality of thrust cylinders 32, fixedly attached between cutterhead 12 and tunneling machine 10, provide relative forward thrusting of cutterhead 12 to cut the tunnel work face.

Tunnel lining segments 34, which are segmented linings known to those skilled in the art, are erected within the cut tunnel by segment erector 36, segment erector tracks 38, and rollers 40. All of the above elements, and the method of lining erection, will be recognized as well known in the art.

Referring to FIGS. 1, 3*a–c*, 6 and 7, the elements allowing operation of tunneling machine 10 in the "open mode" and the "closed mode" will now be described. It should be noted that FIG. 1 shows the "closed mode" of operation. It is to be understood that in the "open mode" tunneling machine 10 operates in self-supporting earth and rock formations and in the absence of significant quantities of pressurized or unpressurized water. It will be understood that, in the "closed mode", tunneling machine 10 can operate in a tunnel in which water pressure, for example, is between about 1.5 and 2 bars. It also will be understood that in the "closed mode" the slurry system is a low flow slurry system in which the pressurized slurry is used only to stabilize the tunnel face, and is not a muck transporting means. In this low flow slurry system muck is extracted from the cutterhead chamber by a screw conveyor and discharged through low volume pressure lock with positive control of the slurry back pressure, which does not require the high capacity muck transportation pumps and large diameter pipe lines of slurry systems known in the art. As will be described below, the fluid balance required for support of the tunnel face (to prevent ground settlement or the creation of excessive voids around the tunnel lining) is achieved by adding a minimal amount of water to the tunnel work face in order to control the face, to fluidize the muck and to reduce cutterhead torque.

Located within cutterhead chamber 23, directly behind cutter supports 20 and roller cutters 18, are screw conveyor 42 and belt conveyor 44. Screw conveyor 42 is permanently oriented at this location, however, belt conveyor 44 is retractable from cutterhead chamber 23 for the "closed mode" configuration of the tunneling machine 10, and is extendable into cutterhead 12 for the "open mode" configuration of tunneling machine 10 in which hard rock is transported along belt conveyor 44. In addition to retraction of belt conveyor 44 in the "closed mode", a bulkhead 45 is securely attached to cutterhead 12, thus sealing cutterhead chamber 23 in an air and liquid tight manner, except for an opening 47 through which screw conveyor 42 passes. Note that screw conveyor 42 is sealed integrally with the opening 47 in the bulkhead 45 in order to maintain pressurization. The bulkhead 45 thus allows pressurization of cutterhead chamber 23. The other end of screw conveyor 42 is connected to pressure lock 46 such that pressurization is maintained.

Figure 3A:
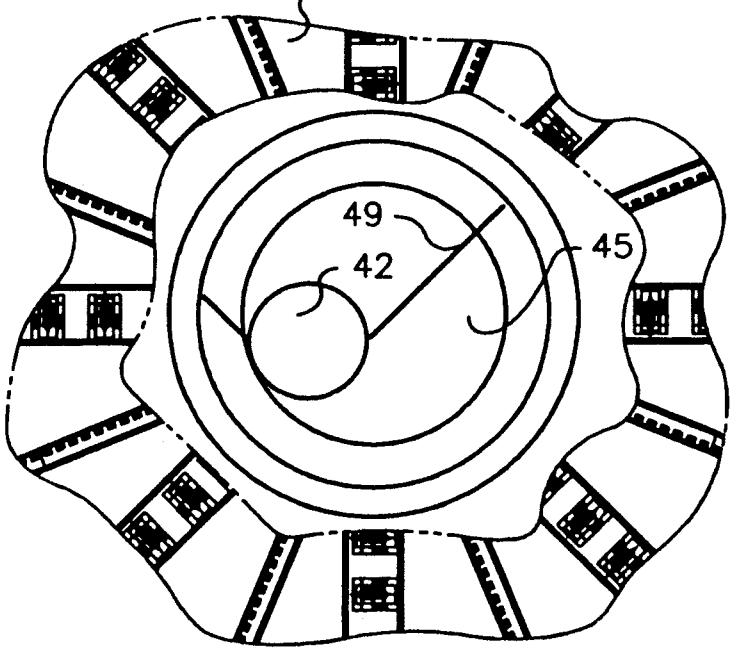
FIG. 3*a* is an enlarged partially exposed view of the cutterhead of FIG. 2 showing the screw conveyor and screw conveyor hopper employed in the "closed mode"
Figure 3C:
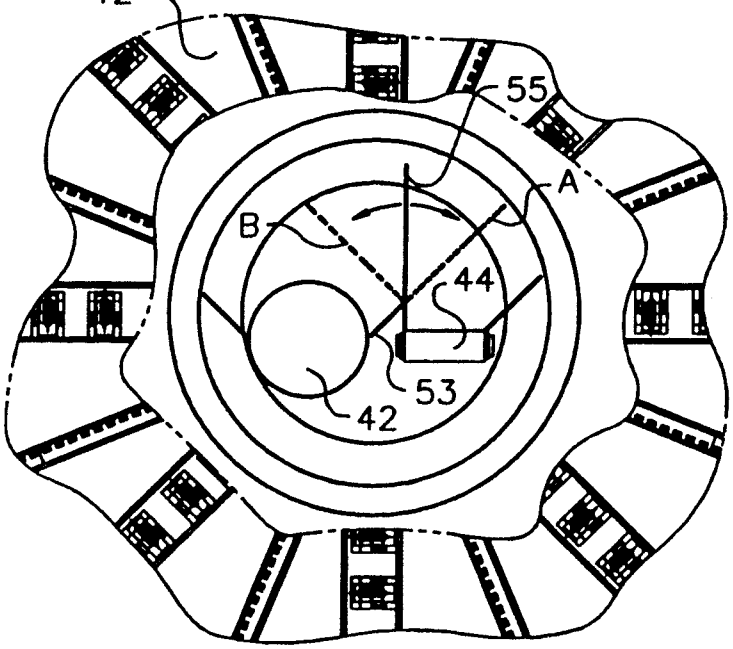
FIG. 3*c* is an enlarged partially exposed view of the cutterhead of FIG. 2 showing the convertible hopper usable in both the "open mode" and the "closed mode".
Figure 3B:
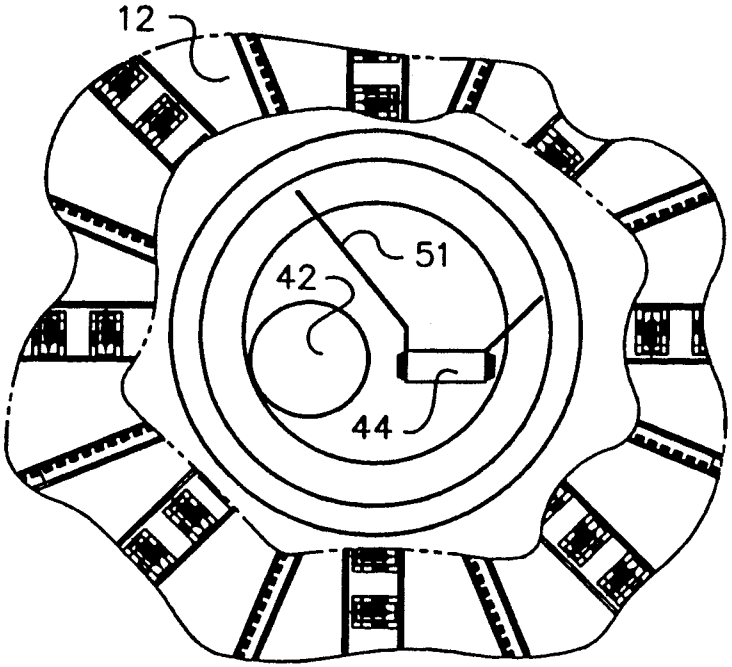
FIG. 3*b* is an enlarged partially exposed view of the cutterhead of FIG. 2 showing the screw conveyor, belt conveyor and belt conveyor hopper employed in the "open mode"

Referring specifically to FIG. 3*a*, the "closed mode" configuration is shown in which screw conveyor hopper 49 is disposed on the screw conveyor 42 at an angle to channel tunneling material into screw conveyor 42. Note that belt conveyor 44 has been retracted into cutterhead chamber 23. Referring now to FIG. 3*b*, the "open mode" of operation is shown in which belt conveyor 44 is extended into cutterhead chamber 23, along with belt conveyor hopper 51. In this "open mode" screw conveyor hopper 49 has been removed for collection of tunneled material by the belt conveyor hopper 51.

In an alternate embodiment of the present invention, screw conveyor hopper 49 and belt conveyor hopper 51 are replaced by convertible hopper 53. Convertible hopper 53 has a swinging chute 55 pivotally attached thereto. Convertible hopper 53 allows collection of tunneled material by either screw conveyor 42 in the "closed mode" or belt conveyor 44 in the "open mode" without the need for interchanging screw conveyor hopper 49 and belt conveyor hopper 51. Belt conveyor 44 need only be retracted or extended and bulkhead 45 added or removed for tunnel boring machine 10 to operate in the "open mode" and the "closed mode", respectively. Specifically, swinging chute 55 is pivoted by swing cylinders known in the art (not shown) such that swinging chute 55 is in position A to channel tunneled material into screw conveyor 42 in the "closed mode". Swinging chute 55 is oriented in position B to channel tunneled material into belt conveyor 44 in the "open mode". Note that FIG. 3*c* shows the "open mode" of operation because belt conveyor 44 is present.

Figure 6:
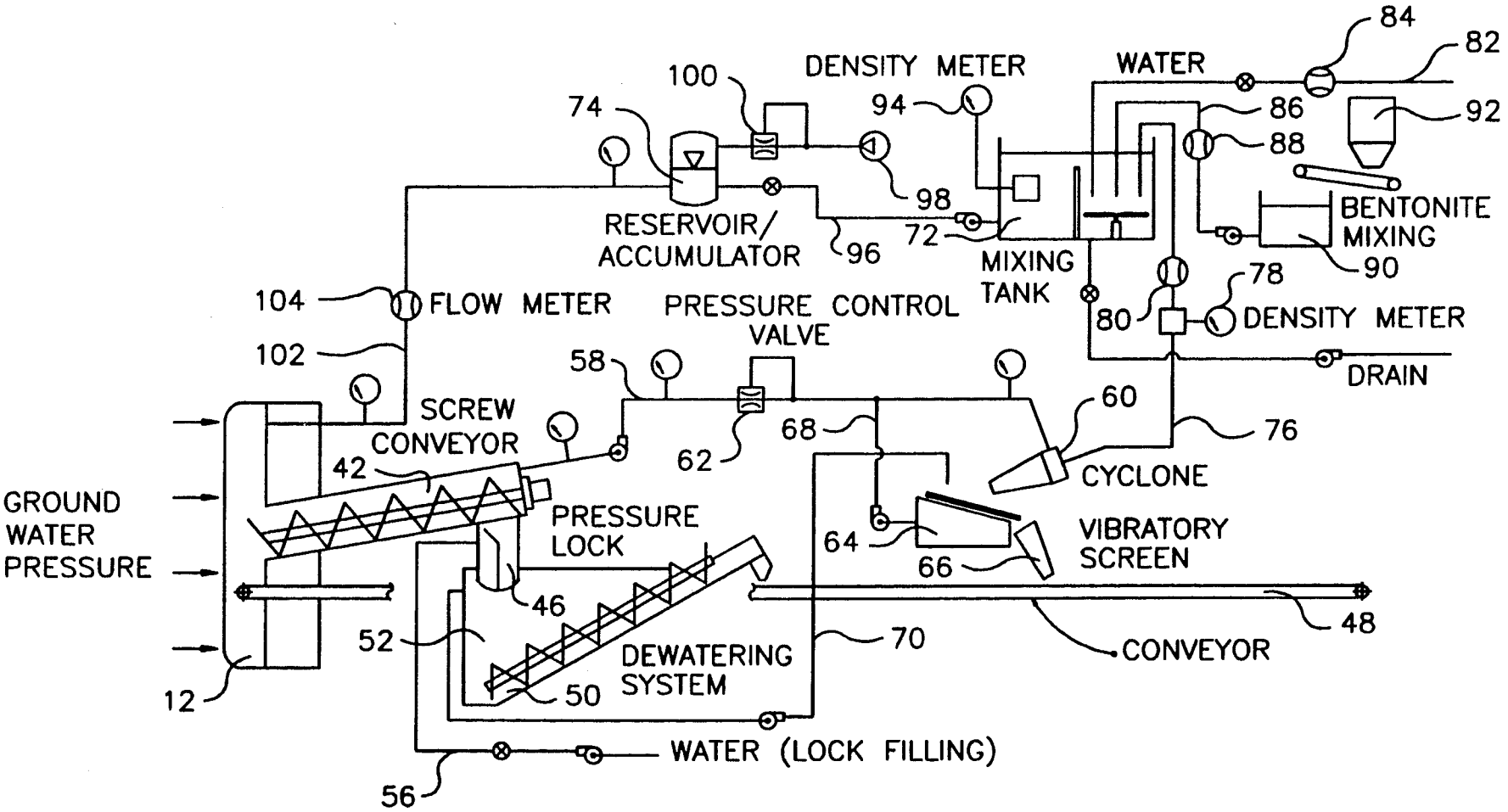
FIG. 6 is a schematic diagram illustrating the "closed mode" of operation of the tunneling machine of FIG. 1.
Figure 7:
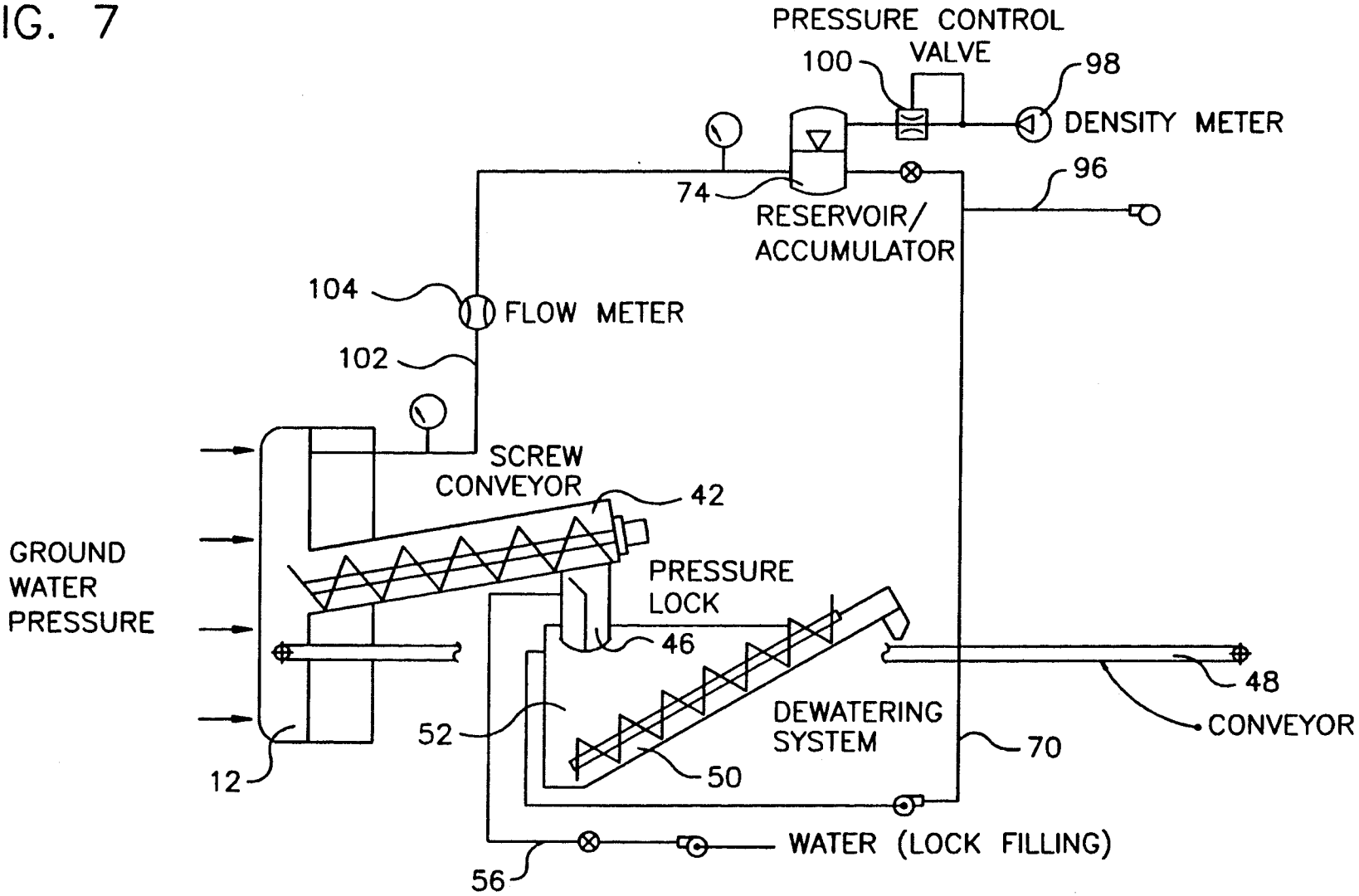
FIG. 7 is a schematic diagram of an alternate embodiment of the "closed mode" of operation of the tunneling machine of FIG. 1.
Figure 9:
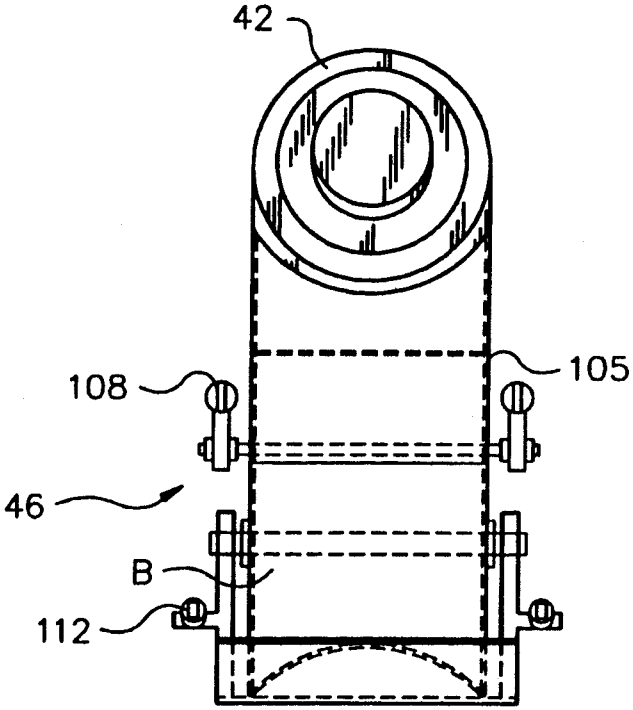
FIG. 9 is an end view of the dual-chamber pressure lock of FIG. 8.
Figure 8:
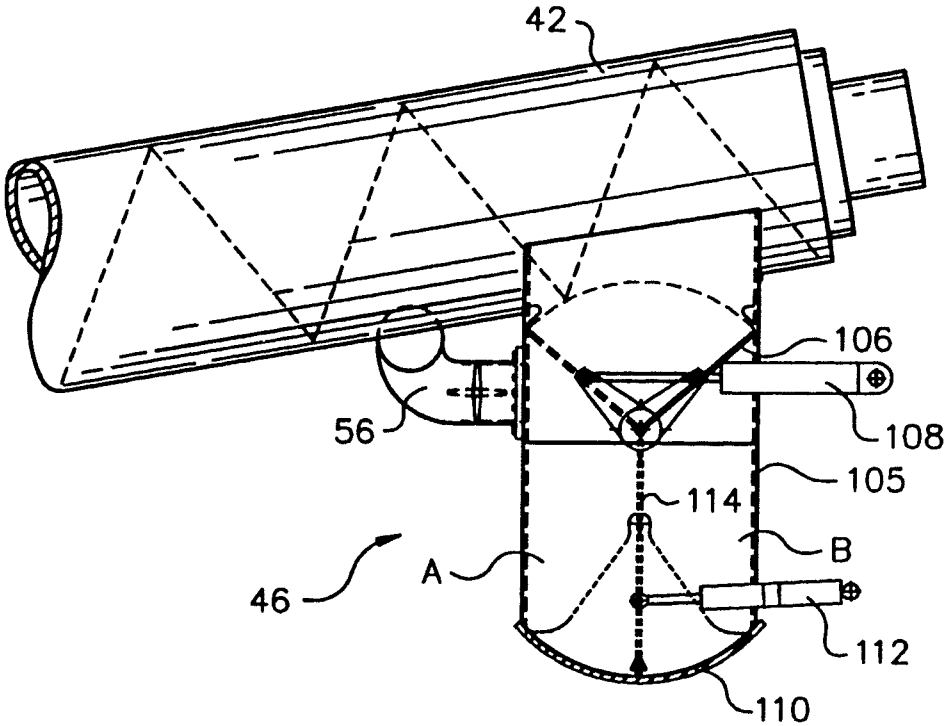
FIG. 8 is a side elevational view of the dual-chamber pressure lock employed in the "closed mode" of operation of the tunneling machine of FIG. 1.

Referring specifically to FIGS. 1, 6 and 7, secondary conveyor 48 is located at the end of belt conveyor 44 remote from cutterhead 12 for removal of rock from the tunnel in the "open mode". Secondary conveyor 48 is also oriented such that it communicates with dewatering screw 50, located in the watering tank 52, for removal of solids on secondary conveyor 48 in the "closed mode".

The following elements all pertain to both of the "closed mode" modes of operation of tunneling machine 10 diagrammatically shown in FIGS. 6 and 7. Connecting dewatering tank 52 to screw conveyor 42 is pressure lock 46. Pressure lock 46 provides an air and liquid tight connection in order to maintain pressure within cutterhead chamber 23 and the tunnel work face to provide a closed system. Pressure lock 46 will be described in greater detail below. Thus, material transported from cutterhead 12 by screw conveyor 42 is removed through pressure lock 46. Optional water line 56 (FIGS. 6 and 7) maintains water in pressure lock 46 to avoid discharging of the pressurized contents of screw conveyor 42 into a void with consequent severe pressure fluctuations.

After passing through pressure lock 46, the material is discharged, at atmospheric pressure, into a dewatering system including dewatering tank 52. The material is removed from the water medium by dewatering screw 50. Sloping dewatering screw 50 elevates and drains the muck, which is then transferred to secondary conveyor 48 for removal from the tunnel. All of the above elements are common to the "closed mode" shown in FIG. 6, which also includes a secondary refining system to be described, and to the "closed mode" of FIG. 7 which does not include the aforesaid secondary refining and separation system.

More specific reference is next made to FIG. 6, in which the "closed mode" system with a secondary refining and separation system is shown. Connected to the downstream end of screw conveyor 42 is hydrocyclone line 58, which is part of an optional hydrocyclone system. Screw conveyor 42 is enlarged at its upper section to provide a passage for the portion of the flow that carries the finer particles which do not separate or by gravity. These "fines" are thus passed along hydrocyclone line 58 to hydrocyclone 60. Hydrocyclone line 58 includes back pressure control valve 62 that maintains the desired pressure within screw conveyor 42, and thus within cutterhead chamber 23. Hydrocyclone 60 communicates with fines separator 64 having vibratory screen 66 which empties material onto secondary conveyor 48 for removal from the tunnel. Separator 64 also includes a return line 68 which feeds into hydrocyclone line 58. Additionally, dewatering line 70 connects dewatering tank 52 to separator 64, thus providing additional material separation from dewatering tank 52.

The main fluid discharge from hydrocyclone 60, containing the very fine solids fraction, is delivered to an optional bentonite adding system including mixing tank 72 along fluid discharge line 76. The solid fraction, after being combined with water or fluidized bentonite, is pumped back to the face as makeup slurry through reservoir/accumulator 74. The fluid discharge line 76 interconnecting cyclone 60 and mixing tank 72 contains a density meter 78 and a flow meter 80 in a manner known in the art. Mixing tank 72 receives water through water line 82 having flow meter 84. Mixing tank 72 receives fluidized bentonite along line 86 which includes flow meter 88. Line 86 receives bentonite from mixing tank 90 and hopper 92. The density of the mixture in mixing tank 72 is monitored by density meter 94. The above bentonite addition system and hydrocyclone system of the optional secondary refining and separation system shown in FIG. 6 serve two purposes: the introduction of fresh bentonite to the face for enhanced stabilization and the more complete removal of fines material in the hydrocyclone.

The secondary refining and separation system of FIG. 6 also comprises a reservoir-accumulator 74 which receives fresh fluidized bentonite through reservoir-accumulator line 96. However, if the optional secondary refining and separation system is not present, as shown in FIG. 7, reservoir/accumulator 74 then receives its input from dewatering line 70 and from a water or bentonite supply source on line 96 (not shown) mixed to supply the correct density. In both embodiments, reservoir/accumulator 74 is interconnected with air compressor 98 having pressure control valve 100. From reservoir/accumulator 74 a low flow makeup slurry, either with or without bentonite, is pumped into cutterhead chamber 23 at a pressure substantially equal to and offsetting the prevailing ground water or earth pressure. Thus, reservoir/accumulator 74 is interconnected with cutterhead chamber 23 by slurry inlet pipe 102, which is in pressure communication with the tunnel face through cutterhead 12. Slurry inlet pipe 102 also includes a flow meter 104.

The pressure at the tunnel face depends on maintaining the appropriate back pressure in the discharge side of the system, specifically at screw conveyor 42 and pressure lock 46, and on controlling the supply side flow, specifically at reservoir accumulator 74, to match the discharge flow. Thus, reservoir/accumulator 74, maintained at a constant preset pressure and connected to slurry inlet pipe 102, substantially eliminates the effects of pressure surges. The level of the air fluid interface in reservoir/accumulator 74 is monitored and the output of the pump on reservoir/accumulator line 96 is varied to maintain the desired level of the air-fluid interface within a desired fixed range.

Reservoir/accumulator 74 also provides a means for maintaining tunnel face pressure during shutdowns. Because the pressure requirement at the tunnel face varies with local conditions, the "closed mode" of FIGS. 6 and 7 are configured to cope with such pressure variations.

Referring next to FIGS. 8 through 11, a first embodiment of pressure lock 46 is disclosed. In this embodiment, pressure lock 46 is a cycling device in housing 105 having a pair of chambers A and B which are alternately filled with slurry, sealed off, and evacuated to prevent the high pressure in screw conveyor 42 from communicating with the atmospheric pressure in dewatering tank 52. The material passed from screw conveyor 42 into one side or the other pressure lock 46 is subsequently discharged at atmospheric pressure into dewatering tank 52. Optionally, the two chambers are alternately flooded with water from water line 56 during the operation to avoid discharging of the pressurized contents of screw conveyor 42 into a void, thus avoiding severe pressure fluctuations.

Pressure lock 46 includes inlet gate 106, which is swung from one side of pressure lock 46 to the other by inlet gate cylinder 108. Outlet gate 110 is likewise swung from one side of pressure lock 46 to the other by outlet gate cylinder 112. Dividing pressure wall 114 in housing 105 partitions pressure lock 46 into chamber A and chamber B.

Figure 11:
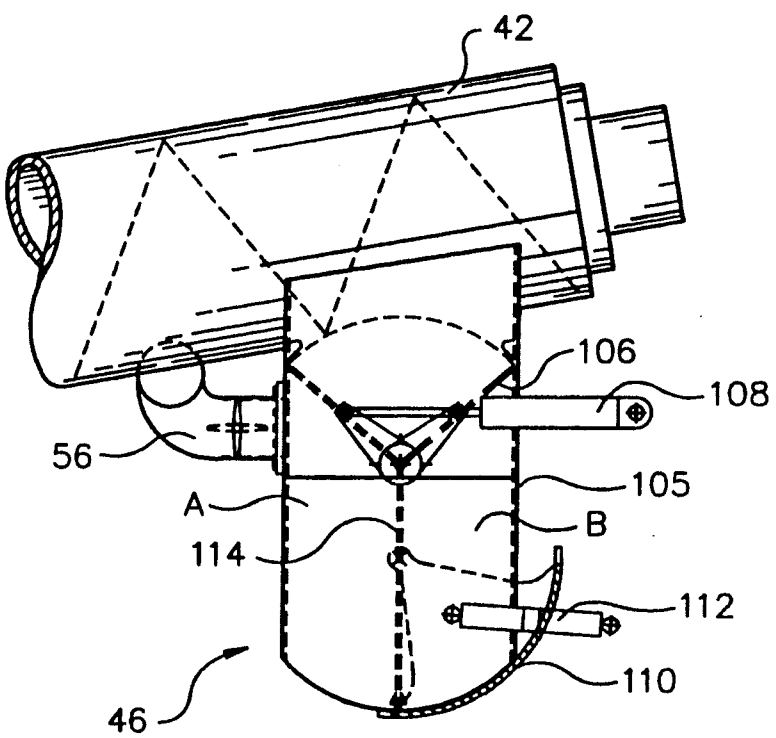
FIG. 11 is a side elevational view of the dual-chamber pressure lock of FIG. 8 with the inlet gate and outlet gate thereof oriented in the same chamber.
Figure 10:
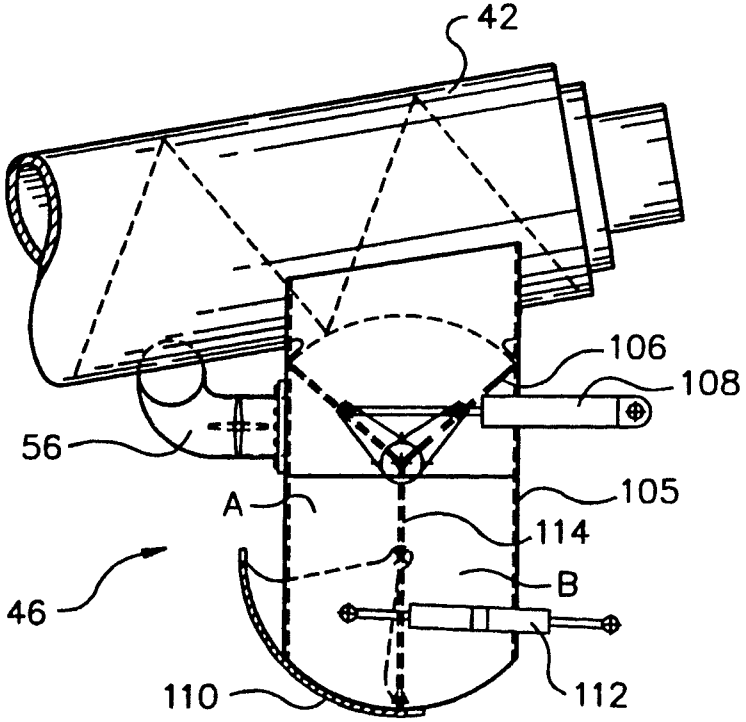
FIG. 10 is a side elevational view of the dual-chamber pressure lock of FIG. 8 with the inlet gate and outlet gate thereof oriented in opposite chambers.

In operation, for example, inlet gate 106 is positioned over chamber B such that material from screw conveyor 42 falls into chamber A. At this time, outlet gate 110 is positioned under chamber A so that the material falls into chamber A. Note that chamber A has previously been filled with water from water line 56. Next, inlet gate 106 moves across pressure lock 46 to be over chamber A. Outlet gate 110 then moves across pressure lock 46 to rest under chamber B (FIG. 11). In this manner, the material in chamber A passes out of pressure lock 46 into dewatering tank 52, and chamber B, which previously was filled with water from water line 56, now receives additional material from screw conveyor 42. The above process is repeated in a cyclical manner as the discharge progresses.

Figure 12:
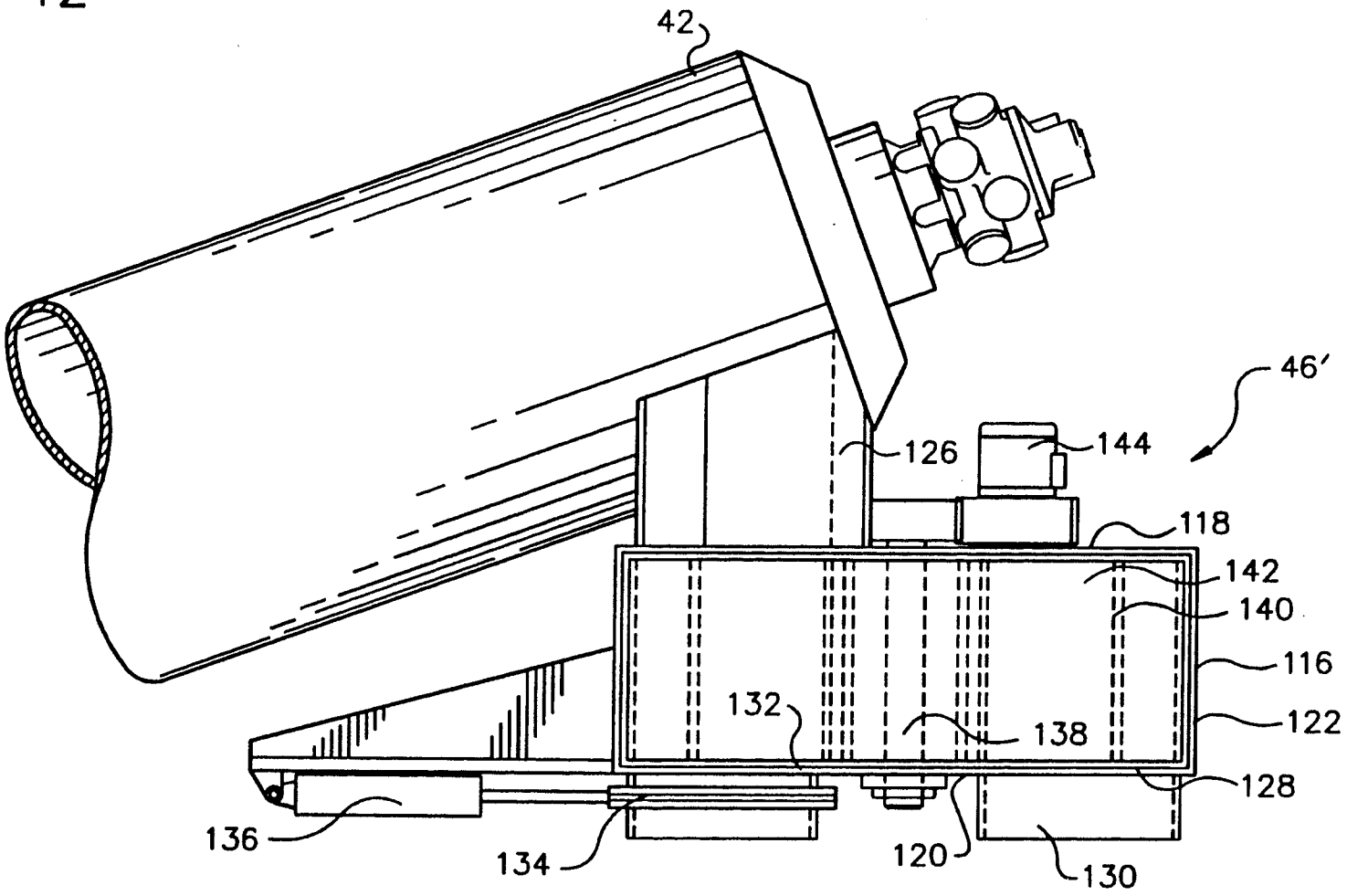
FIG. 12 is a side elevational view of an alternate embodiment of the pressure lock of the present invention having a low profile carousel configuration.
Figure 13:
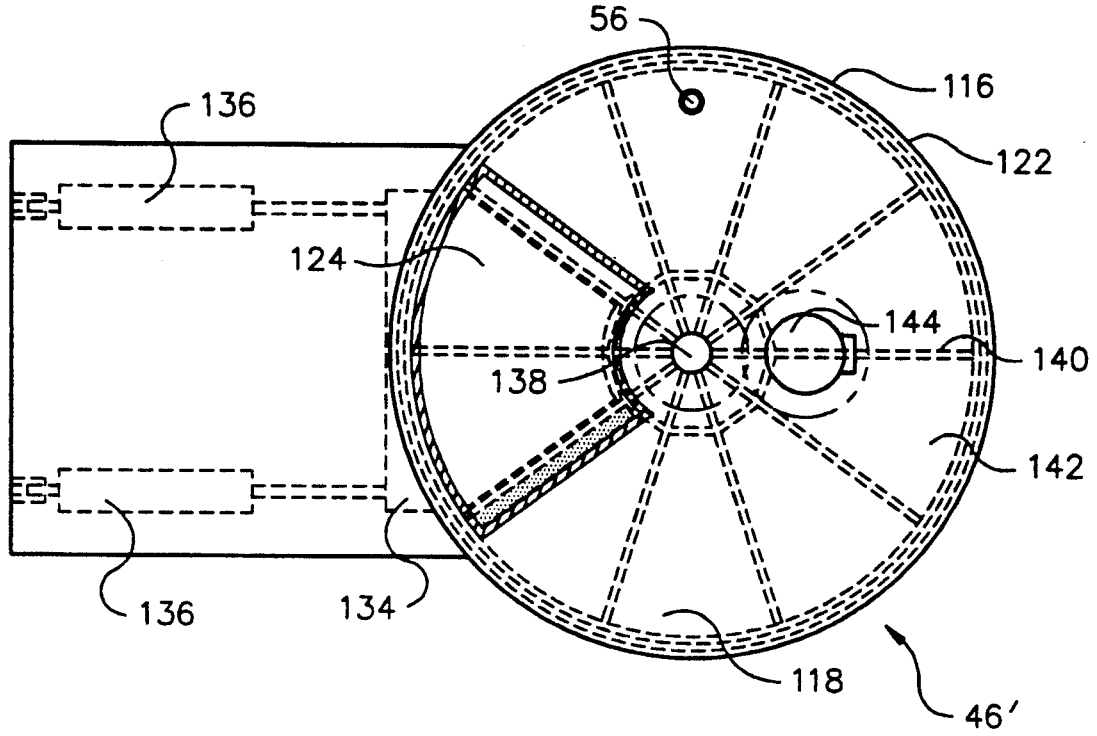
FIG. 13 is a top view of the carousel-type pressure lock of FIG. 12.
Figure 14:
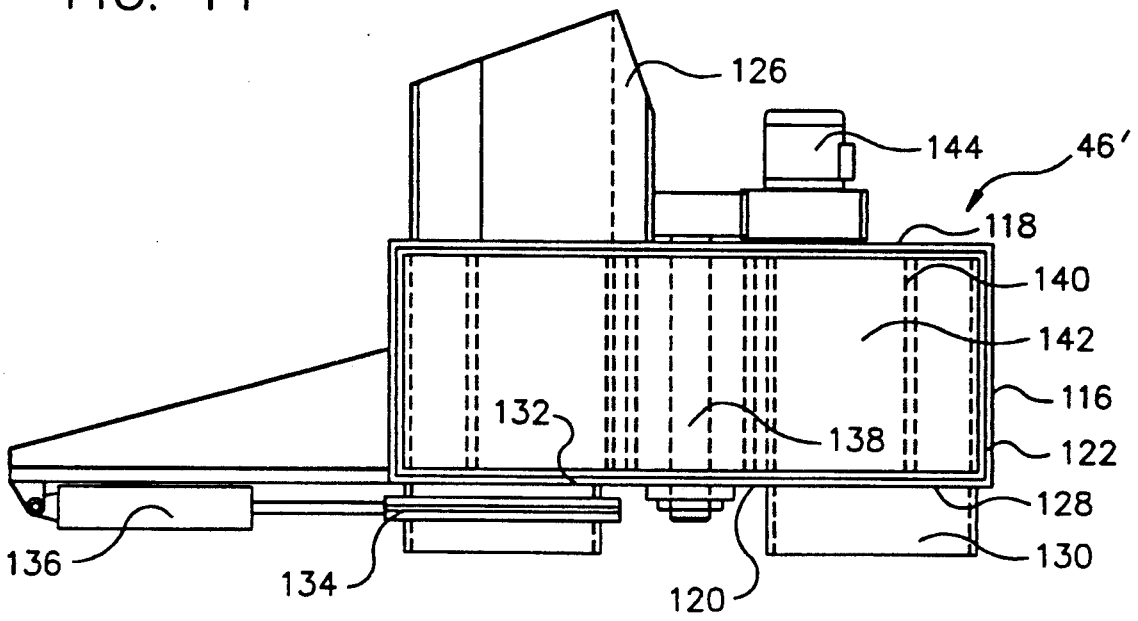
FIG. 14 is a partial view of the side elevational view of the carousel type pressure lock of FIGS. 12 and 13.

Now referring to FIGS. 12 through 14, an alternate embodiment of pressure lock mechanism according to the present invention is described in detail. Specifically, pressure lock 46' provides substantially continuous material delivery into dewatering tank 52 from screw conveyor 42. Thus, pressure lock 46' is considered less likely than a gate type lock to cause pressure pulsations at the tunnel face. Additionally, pressure lock 46', being a carousel type delivery system, provides a lower profile that enables tunneling machine 10 to also have a lower profile.

Pressure lock 46' is comprised of carousel housing 116 integrally formed of top 118, bottom 120 and side 122. In top 118 is entrance 124 which is connected to screw conveyor 42 by entrance chute 126. In bottom 120 is exit 128 which communicates with exit chute 130 leading to dewatering tank 52. It is to be noted that entrance 124 in top 120 and exit 128 in bottom 120 are located on opposite sides of carousel housing 116. Located directly under entrance 124 is secondary exit 132 in bottom 120. Slidably mounted over secondary exit 132 is secondary exit plate 134. Secondary exit cylinders 136 are interconnected with secondary exit plate 134 to cause sliding engagement and disengagement of secondary exit plate 134 with secondary exit 132.

Axle 138 passes through the vertical axis of carousel 116 and fixedly secures a plurality of partitions 140 radially disposed within carousel 116 to form wedge shaped chambers 142. Relative rotation of axle 138, partitions 140 and chambers 142 (either clockwise or counterclockwise) relative to carousel housing 116 is caused by motor 144.

During operation of pressure lock 46', material from screw conveyor 42 passes through entrance chute 126 and entrance 124 in top 118 of carousel housing 116. The material thus enters one of a plurality of chambers 142 between adjacent radial partitions 140. Optionally, the chamber 142 that receives material through chute 121 can, prior thereto, be filled with water from water line 56 in order to minimize pressure fluctuations at the tunnel face and within cutterhead 12. It is to be noted that wedge-shaped chamber 142 and the material received through entrance chute 126 are in a pressurized state due to the integral connection of screw conveyor 42, entrance chute 126 and carousel housing 116. Actuation of motor 144 causes the chamber 142 containing the material to rotate with partitions 140 and axis 138. When this chamber 142 containing material reaches exit 128 in bottom 120, the material passes through exit 128 into exit chute 130 and is deposited in dewatering tank 52. Note that dewatering tank 52 is at atmospheric pressure, and thus exit chute 130 is also at atmospheric pressure. After this particular chamber 142 has dumped the material, it can, at this time, optionally be filled with water from water line 56 as stated above. The above process continues in a cyclical mode.

Optionally, if it is desired to bypass pressure lock 46', secondary exit cylinders 136 are retracted, thus slidably removing secondary exit plate 134 from secondary exit 132. Additionally, motor 144 is deactivated. Now, material passing from screw conveyor 42 through entrance chute 126 and entrance 124 in top 118 will pass through carousel housing 116 and secondary exit 132 in bottom 120. In this manner, material will pass directly through carousel housing 116 and can then be transported by secondary conveyor 148 out of the tunnel without processing in dewatering tank 52.

While particular embodiments of the present invention have been described in some detail hereinabove, changes an modifications may be made in these embodiments without departing from the spirit and scope of the invention as defined in the following claims.

What is claimed is:

1. In a slurry type tunneling machine having a full face rotary cutterhead with a plurality of cutter units and muck openings therein and a pressurized cutterhead chamber with a removable bulkhead in which slurry is to be maintained by a pressure maintenance system at a pressure sufficient to support the tunnel workface during the tunneling operation, the improvement wherein the pressure maintenance system comprises:

inlet means for delivering makeup slurry to said pressurized cutterhead chamber;

pressurized conveyor means for receiving and withdrawing tunneled material and slurry from said pressurized cutterhead chamber;

pressure lock means receiving the tunneled material and slurry from said pressurized conveyor means and discharging same at substantially atmospheric pressure;

means connected to said pressure lock means for processing the tunneled material and slurry discharged from said pressure lock means and acting to seperate and discharge most of the tunneled material solids to conveyor means for removal from the tunnel;

means including reservoir-accumulator means for recycling essentially all of the liquid discharged from said means for processing tunneled material and slurry to the pressurized cutterhead chamber, with slurry makeup as necessary, in a manner maintaining the pressure in said chamber, and consequently the pressure at the tunnel workface, sufficient to support the workface; and second conveyor means adapted to be inserted into the cutterhead chamber upon removal of the bulkhead, said second conveyor means being adapted to transport material tunneled from the tunnel work face at substantially atmospheric pressure when the tunnel workface is self-supporting.

2. The slurry type tunneling machine of claim 1, wherein said pressure lock means is a dual chambered pressure lock, comprising:

a housing having an inlet connected to said conveyor means and an outlet adjacent said means for processing said tunneled material;

a partition dividing said housing into a first chamber and a second chamber such that said outlet and said inlet each communicates with both said first chamber and said second chamber;

an inlet gate swingable between said first chamber and said second chamber;

an outlet gate swingable between said first chamber and said second chamber; and means for swinging said inlet gate and said outlet gate between said first chamber and said second chamber such that said first chamber and said second chamber each alternately receives tunneled material through said inlet under pressure from said conveyor means and dumps tunneled material through said outlet at substantially atmospheric pressure into said means for processing tunneled material.

3. The slurry type tunneling machine of claim 2, further comprising:

a water line connected to said housing of said dual chamber pressure lock whereby each of said first chamber and said second chamber is filled with water from said water line when devoid of tunneled material in order to minimize pressure fluctuations in the cutterhead chamber when tunneled material is received by said first and second chamber.

4. The slurry type tunneling machine of claim 1, wherein said pressure lock means is a low profile carousel pressure lock comprising:

a housing having a substantially circular top, a substantially circular bottom, a side connecting said top and said bottom, an interior, an inlet in said top connected to said conveyor means, and an outlet in said bottom adjacent said means for processing tunneled material;

an axle through the center of said interior of said housing, said axle substantially perpendicular to said top and said bottom, said axle being rotatable relative to said housing;

a plurality of partitions connected to said axle and radiating outwardly therefrom to form a plurality of chambers within said interior of said housing; and means for rotating said axle, said partitions, and said chambers relative to said housing whereby each of said plurality of chambers receives tunneled material through said inlet under pressure from said conveyor means and dumps tunneled material through said outlet at substantially atmospheric pressure into said means for processing tunneled material.

5. The slurry type tunneling machine of claim 4, further comprising:

water line delivery means connected to said housing of said low profile carousel pressure lock whereby each of said chambers is filled with water from said water line delivery means when devoid of tunneled material from said conveyor means in order to minimize pressure fluctuations in the cutterhead chamber when tunneled material is being received by each of said chambers.

6. The slurry type tunneling machine of claim 4, further comprising:

a secondary outlet in said bottom of said low profile carousel pressure lock, said secondary outlet being axially aligned with said inlet;

a secondary outlet plate positionable over said secondary outlet; and means for positioning said secondary outlet plate over said secondary outlet for transport of tunneled material in said low profile carousel pressure lock, and for positioning said secondary outlet plate remote from said secondary outlet for passage of tunneled material through said inlet and said outlet without being transported in said low profile carousel pressure lock.

7. The slurry type tunneling machine of claim 1, wherein said means including reservoir/accumulator means further comprises:

fines removal means receiving solids fines and water components of the tunneled material from said conveyor means for separation thereof; and bentonite adding means receiving fines material from said fines removal means and receiving bentonite from bentonite supply means, said bentonite adding means adding bentonite to the low slurry flow in said inlet for passage to the tunnel face.

8. A liquid balance system in a tunneling machine for supporting a tunnel face by a low slurry flow, the tunneling machine including a rotatable cutterhead having a plurality of cutting units and having muck openings communicating with a cutterhead chamber, said liquid balance system comprising:

a removable bulkhead forming part of the cutterhead chamber enabling pressurization of the cutterhead chamber and the tunnel face;

inlet means through said bulkhead and into the cutterhead chamber permitting passage of low flow slurry into the cutterhead chamber at a rate maintaining the desired pressure in the cutterhead chamber and at the tunnel face;

conveyor means through said bulkhead and out of the cutterhead chamber for removal of tunneled material from the cutterhead chamber, said conveyor means being associated with said bulkhead in a manner permitting the maintaining of the desired pressure in the cutterhead chamber and at the tunnel face;

pressure lock means receiving tunneled material from said conveyor means and transporting the tunneled material for processing at substantially atmospheric pressure;

means connected to said pressure lock means for processing said tunneled material to remove most of the solids therefrom;

reservoir/accumulator means connected to said means for processing tunneled material, said reservoir/accumulator means also being connected to said inlet means for passage of low flow slurry into the cutterhead chamber, said reservoir/accumulator means functioning to control the flow rate of the low flow slurry through said inlet means to match the removal of tunneled material by said conveyor means to maintain the desired liquid balance pressure in the cutterhead chamber and at the tunnel face; and second conveyor means adapted to be inserted into said cutterhead chamber upon removal of said bulkhead, said second conveyor means being adapted to transport material tunneled from the tunnel workface at substantially atmospheric pressure when the tunnel workface is self-supporting.

9. The liquid balance system of claim 8, wherein said pressure lock means is a dual chambered pressure lock comprising:

a housing having an inlet connected to said conveyor means and an outlet adjacent said means for processing said tunneled material;

a partition dividing said housing into a first chamber and a second chamber such that said outlet and said inlet each communicates with both said first chamber and said second chamber;

an inlet gate swingable between said first chamber and said second chamber;

an outlet gate swingable between said first chamber and said second chamber; and means for swinging said inlet gate and said outlet gate between said first chamber and said second chamber such that said first chamber and said second chamber each alternately receives tunneled material through said inlet under pressure from said conveyor means and dumps tunneled material through said outlet at substantially atmospheric pressure into said means for processing tunneled material.

10. The system of claim 9, further comprising:

a water line connected to said housing of said dual chamber pressure lock whereby each of said first chamber and said second chamber is filled with water from said water line when devoid of tunneled material in order to minimize pressure fluctuations in the cutterhead chamber when tunneled material is received by said first and second chamber.

11. The liquid balance system of claim 8, wherein said pressure lock means is a low profile carousel pressure lock comprising:

a housing having a substantially circular top, a substantially circular bottom, a side connecting said top and said bottom, an interior, an inlet in said top connected to said conveyor means, and an outlet in said bottom adjacent said means for processing tunneled material;

an axle through the center of said interior of said housing, said axle substantially perpendicular to said top and said bottom, said axle being rotatable relative to said housing;

a plurality of partitions connected to said axle and radiating outwardly therefrom to form a plurality of chambers within said interior of said housing; and means for rotating said axle, said partitions, and said chambers relative to said housing whereby each of said plurality of chambers receives tunneled material through said inlet under pressure from said conveyor means and dumps tunneled material through said outlet at substantially atmospheric pressure into said means for processing tunneled material.

12. The system of claim 11, further comprising:

water line delivery means connected to said housing of said low profile carousel pressure lock whereby each of said chambers is filled with water from said water line delivery means when devoid of tunneled material from said conveyor means in order to minimize pressure fluctuations in the cutterhead chamber when tunneled material is being received by each of said chambers.

13. The system of claim 11, further comprising:

a secondary outlet in said bottom of said low profile carousel pressure lock, said secondary outlet being axially aligned with said inlet;

a secondary outlet plate positionable over said secondary outlet; and means for positioning said secondary outlet plate over said secondary outlet for transport of tunneled material in said low profile carousel pressure lock, and for positioning said secondary outlet plate remote from said secondary outlet for passage of tunneled material through said inlet and said outlet without being transported in said low profile carousel pressure lock.

14. The system of claim 8, wherein said reservoir/accumulator means comprises:

fines removal means receiving solids fines and water components of the tunneled material from said conveyor means for separation thereof; and bentonite adding means receiving fines material form said fines removal means and receiving bentonite form bentonite supply means, said bentonite adding means adding bentonite to the low slurry flow in said inlet for passage to the tunnel face.

15. A tunneling machine employing a liquid balance system with a low slurry flow, said tunneling machine comprising:

a main frame;

a cutterhead having a plurality of cutting units and having muck passages communicating with a cutterhead chamber, said cutterhead being rotatable relative to said main frame;

means for rotating said cutterhead relative to said main frame;

a removable bulkhead attached to the cutterhead chamber for pressurization of the cutterhead chamber and the tunnel face;

inlet means through said bulkhead and into the cutterhead chamber for passage of the low flow slurry through the cutterhead chamber to maintain the desired pressure in the cutterhead chamber and at the tunnel face;

conveyor means through said bulkhead and into the cutterhead chamber for removal of tunneled material from the cutterhead chamber and the tunnel face, said conveyor means attached to said bulkhead to maintain the desired pressure in the cutterhead chamber and at the tunnel face;

pressure lock means external to said bulkhead and the cutterhead chamber and attached to said conveyor means, said pressure lock means being adapted to receive tunneled material from said conveyor means and to transport the tunneled material for processing at substantially atmospheric pressure while maintaining the desired pressure in the cutterhead chamber and at the tunnel face;

means for processing said tunneled material, said means for processing connected to said pressure lock means;

reservoir/accumulator means connected to said means for processing tunneled material, said reservoir/accumulator means being also connected to said inlet means for passage of low flow slurry into the cutterhead chamber, said reservoir/accumulator means being also adapted to control the flow rate of the low flow slurry through said inlet means to means the removal of tunneled material by said conveyor means to maintain the pressure in the cutterhead chamber and at the tunnel face; and second conveyor means adapted to be inserted into said cutterhead chamber upon removal of said bulkhead, said second conveyor means adapted to transport material tunneled from a self-supporting tunnel face at substantially atmospheric pressure.

16. The tunneling machine of claim 15, wherein said pressure lock means is a dual chambered pressure lock comprising:

a housing having an inlet connected to said conveyor means and an outlet adjacent said means for processing said tunneled material;

a partition dividing said housing into a first chamber and a second chamber such that said outlet and said inlet each communicates with both said first chamber and said second chamber; p1 an inlet gate swingable between said first chamber and said second chamber;

an outlet gate swingable between said first chamber and said second chamber; and means for swinging said inlet gate and said outlet gate between said first chamber and said second chamber such that said first chamber and said second chamber each alternately receives tunneled material through said inlet under pressure from said conveyor means and dumps tunneled material through said outlet at substantially atmospheric pressure into said means for processing tunneled material.

17. The tunneling machine of claim 16, further comprising:

a water line connected to said housing of said dual chamber pressure lock wherein each of said first chamber and said second chamber void is filled with water from said water line when devoid of tunneled material from said conveyor means in order to minimize pressure fluctuations as in the cutterhead chamber and at the tunnel face when tunneled material is received by said first and second chambers.

18. The tunneling machine of claim 15, wherein said pressure lock means is a low profile carousel pressure lock comprising:

a housing having a substantially circular top, a substantially circular bottom, a side connecting said top and said bottom, in interior, an inlet in said top connected to said conveyor means, and an outlet in said bottom adjacent said means for processing tunneled material;

an axle through the center of said interior of said housing, said axle substantially perpendicular to said top and said bottom, said axle rotatable relative to said housing;

a plurality of partitions connected to said axle and radiating outwardly therefrom to form a plurality of chambers within said interior of said housing; and means for rotating said axle, said partitions and said chambers relative to said housing whereby each of said plurality of chambers receives tunneled material through said inlet under pressure from said conveyor means and dumps tunneled material through said outlet at substantially atmospheric pressure into said means for processing tunneled material.

19. The tunneling machine of claim 18, further comprising:

a water line connected to said housing of said low profile carousel pressure lock whereby each of said chambers is filled with water from said water line when devoid of tunneled material from said conveyor means in order to minimize pressure fluctuations in the cutterhead chamber and at the tunnel face when tunneled material is received by each of said chambers.

20. The tunneling machine of claim 18, further comprising:

a secondary outlet in said bottom of said low profile carousel pressure lock, said secondary outlet aligned with said inlet;

a secondary outlet plate positionable over said secondary outlet; and means for positioning said secondary outlet plate over said secondary outlet for transport of tunneled material in said low profile carousel pressure lock and for positioning said secondary outlet plate remote from said secondary outlet for passage of tunneled material through said inlet and said outlet without being transported in said low profile carousel pressure lock.

21. The tunneling machine of claim 15, wherein said reservoir/accumulator means comprises:

fines removal means receiving the tunneled material in the form of solid fines and water from said conveyor means for separation thereof; and bentonite adding means receiving fines material from said fines removal means and receiving bentonite from a bentonite holder, said bentonite adding means adding bentonite to the low slurry flow in said inlet for passage to the tunnel face.

* * * * *